US006855261B2

(12) United States Patent
Boutte et al.

(10) Patent No.: US 6,855,261 B2
(45) Date of Patent: Feb. 15, 2005

(54) METHOD FOR HANDLING AND DISPOSING OF DRILL CUTTINGS

(76) Inventors: Kenneth J. Boutte, 225 Kings Rd., Lafayette, LA (US) 70503; Ban D. Green, 402 Interlude Rd., New Iberia, LA (US) 70563

( * ) Notice: Subject to any disclaimer, the term of this patent is extended or adjusted under 35 U.S.C. 154(b) by 162 days.

(21) Appl. No.: 09/900,264

(22) Filed: Jul. 6, 2001

(65) Prior Publication Data

US 2003/0006201 A1 Jan. 9, 2003

(51) Int. Cl.[7] ..... B01D 37/00

(52) U.S. Cl. ..... 210/768; 210/770; 100/37; 53/438; 53/459; 175/206

(58) Field of Search ..... 100/36, 37, 39, 100/104, 110, 116, 123; 210/768, 769, 770, 803; 175/5, 206; 53/436, 438, 459, 469, 529, 570

(56) References Cited

U.S. PATENT DOCUMENTS 4,439,069 A * 3/1984 Kelly et al. ..... 405/195.1
4,480,702 A 11/1984 Kelly, Jr.
4,595,422 A * 6/1986 Hill et al. ..... 134/19
4,747,961 A 5/1988 Beer
4,793,423 A 12/1988 Knol
4,836,302 A 6/1989 Heilhecker
4,878,576 A 11/1989 Dietzen
4,942,929 A 7/1990 Malachosky
5,090,498 A 2/1992 Hamill
5,303,786 A 4/1994 Prestridge
5,402,857 A 4/1995 Dietzen
5,564,509 A 10/1996 Dietzen
5,582,118 A 12/1996 Atkins
5,662,807 A 9/1997 Angelle
5,842,529 A * 12/1998 Dietzen ..... 175/66
5,846,440 A 12/1998 Angelle
6,170,580 B1 1/2001 Reddoch
6,179,071 B1 1/2001 Dietzen
6,216,800 B1 4/2001 Wilson
6,386,026 B1 * 5/2002 Zamfes ..... 73/152.04

* cited by examiner

*Primary Examiner*—Robert James Popovics
(74) *Attorney, Agent, or Firm*—William W. Stagg

(57) ABSTRACT

A method and apparatus for handling the drill cuttings removed from the drilling mud of an oil and gas well drilling rig is disclosed. The apparatus and method utilize a shaker for separating drill cuttings from the mud, conduit for transporting the drill cuttings so separated to an extruder where the separated cuttings are crushed and compacted into a plurality of discrete compacted pellet-like bodies of a substantially uniform size. Once extruded into pellets, the pelletized cuttings are transported by conveyors to fill collapsible, sealable storage bags that have be positioned on bag racks. When filled the storage bags are filled and then ultimately delivered to a desired location for disposal or further handling.

26 Claims, 1 Drawing Sheet

METHOD FOR HANDLING AND DISPOSING OF DRILL CUTTINGS

FIELD OF INVENTION

This invention relates to the field of oil and gas exploration and, more particularly, relates to a method for handling, compacting, storing and disposing of drill cuttings at a well location, whether onshore or offshore, so that the cost of handling and disposing the cuttings will be reduced.

BACKGROUND OF THE INVENTION

In rotary drilling for the exploration for oil and gas, a liquid slurry know as drilling mud is utilized for maintenance and lubrication of the borehole created during the drilling operation. Typically the drilling mud system of a well includes a mud holding tank at the well surface located on or adjacent to the drilling rig and a network of pumps, mixers and mud supply lines. During rotary drilling operations, drilling mud is pumped from the mud holding tank, through the mud supply lines, down through the well bore at the desired rate and is returned to the surface of the well bore. The returned drilling mud carries with it drill cuttings from the bottom of the borehole produced as rotary drilling is advanced.

When the circulating drilling mud, along with the carried drill cuttings, is returned to the surface, it is delivered to a screening device know as a "shaker" which serves as a sieve for removing the carried drill cuttings from the drilling mud. When the drill cuttings have been removed from the drilling mud by the shaker, the drilling mud is returned to the mud storage tank for reuse. The drill cuttings separated from the drilling mud are collected and conveyed to storage tanks for treating and disposal.

The storage and disposal of drill cuttings produced at a drilling location can present difficult problems. The drill cuttings removed from the borehole are typically comprised of shale, sand, hard clays, or shell and they are often coated with, or contain, residual contaminants from the drilling mud or from the borehole. The drill cuttings and their contaminants present environmental concerns that must be addressed during their disposal. The storage of the drill cuttings at the drill site prior to disposal can also present many problems, particularly on offshore drilling locations where storage space on drilling platforms is limited. The drill cuttings are typically stored on drilling locations in rigid cuttings boxes. These boxes are heavy, bulky and take up valuable platform space. Platform space must be allocated not only to cuttings boxes filled with cuttings that have been removed from the borehole but also to cuttings boxes waiting to be filled with drill cuttings that have been removed from the drilling mud.

Transporting the drill cuttings from a rig site to a disposal facility, whether from an onshore or an offshore drilling location, is also a concern because of the costs associated with transporting the bulky, heavy cuttings boxes to and from the well location. In addition, drill cuttings often must undergo some treatment to remove or render inert any associated contaminates prior to their disposal. Consequently, a need exists for improved methods of handling, storing and transporting drill cuttings produced at a drilling location.

BRIEF SUMMARY OF INVENTION

Applicants' present invention is intended to present a method for the handling, storing and transportation of drill cuttings. The method incorporates a conveying means to transport the drill cuttings removed from the drilling mud slurry to a compacting device. The compacting device crushes and compacts the drill cuttings into pellets of a desired size. The "pelletized" drill cuttings are then conveyed to a collecting site situated on the well location and delivered to storage bags suspended on racks. As each storage bag is filled, the storage bag is removed from the rack and replaced with another bag. The storage bags containing the cuttings are stored on site and are eventually shipped off the drilling location by boat, in the case of an offshore drilling location, or by truck, in the case of an onshore drilling location.

DESCRIPTION OF THE EMBODIMENTS

Figure 1:
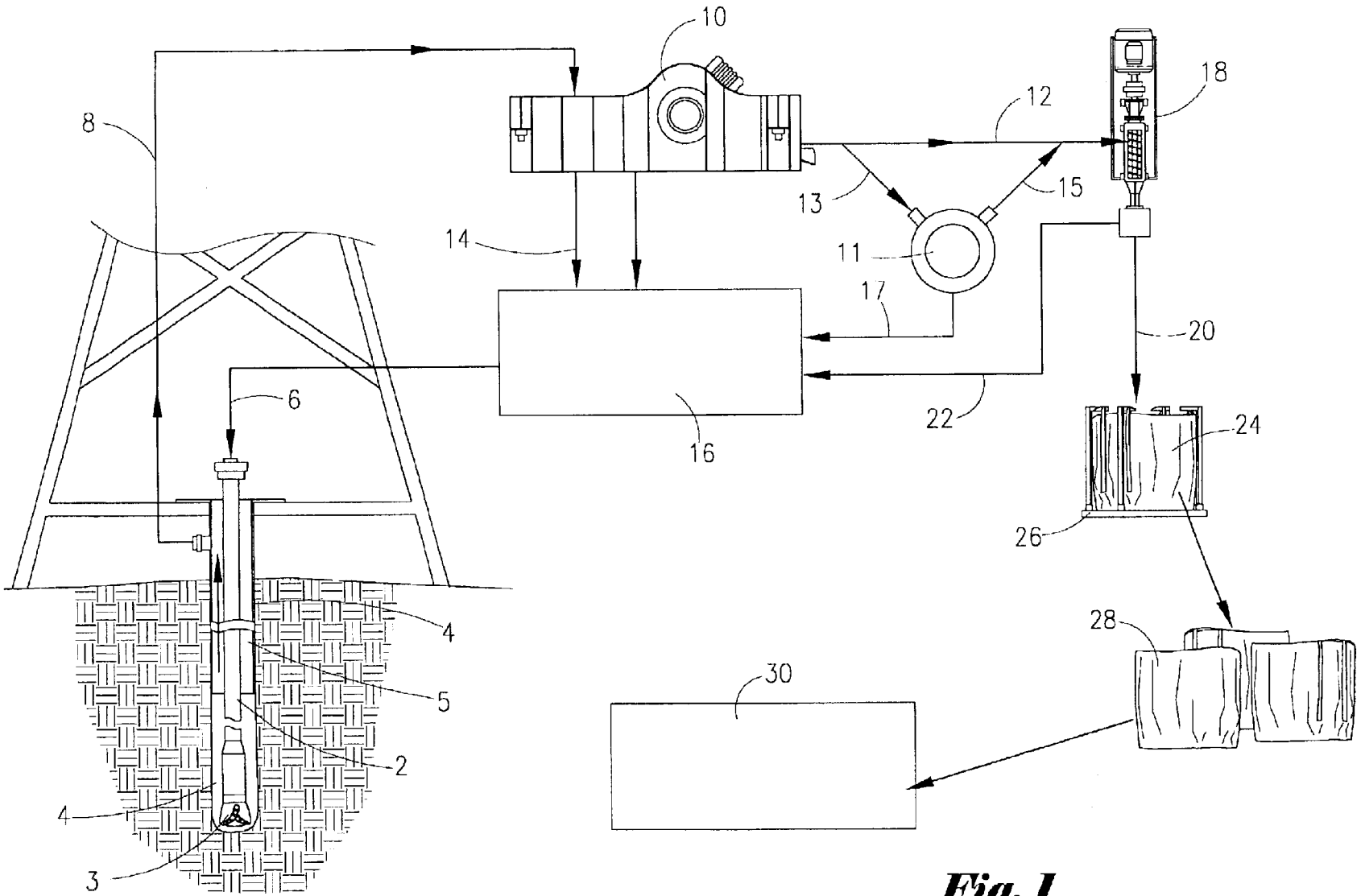
FIG. 1 is a schematic of the drill cutting handling system of Applicants' invention.

FIG. 1 shows a schematic view of the drill cuttings handling system and method of Applicants' invention. The drill cuttings to be handled according to Applicants' invention are produced by a drill bit 3, mounted on a drill string 2, as drilling advances to create a borehole 4. As the drilling advances, the borehole 4 is typically lined with a casing 5.

During the drilling of the borehole 4, the drilling string 2 is inserted through casing 5 down to the bottom of borehole 4. The drill string 2 forms a portion of the drilling mud line 6 used to pump a liquid slurry know as drilling mud from a drilling mud storage tank 16 through the drill string 2 to the bottom of the borehole 4. The drilling mud conditions and lubricates the borehole 4 and serves to counteract geostatic pressures in the borehole 4 that are encountered during drilling.

The casing 5 typically extends to the surface of the borehole 4. Drilling mud leaving the drill string 2 is circulated to the surface of the borehole 4 via the casing 5 and carries with it the cuttings produced by the drill bit 3 as the borehole 4 is advanced. The cuttings produced by the drill bit 3 are called drill cuttings.

The drilling mud, and any carried drill cuttings, that is returned to the surface of the borehole 4 via casing 5 is transported via mud line 8 to a shaker 10 by pumping or other transporting means. The shaker 10 is a screening device that separates the carried drill cuttings from the drilling mud. After the drilling mud is transported through the shaker 10, it is returned, via mud lines 14, to the mud storage tank 16. The cuttings removed from the drilling mud by the shaker 10 are transported, via conveyors 12, to a cuttings compactor 18.

If the cuttings removed by the shaker 10 are excessively wet, they may be selectively transported, via conveyor 13, to a secondary shaker 11 for further removal of retained fluids. Cuttings from secondary shaker 11 are then delivered to the compactor 18 via conveyor 15. The liquids removed from the cuttings by the secondary shaker 11 are then returned to the mud storage tank 16 via mud return line 17.

The cuttings removed from the drilling mud are typically of a gravel-like consistency. Conveyors for transporting such cuttings are well known. Conveyors 12, 13 and 15, used to transport the cuttings to the shaker 10, the secondary shaker 11, or to the compactor 18, may be comprised of gravity lines, trough and auger combinations, belt conveyors, screen conveyors, pneumatic lines or any other such device designed to transport the cuttings.

The shaker 10 utilized as described above may be selected from anyone of a number of drill cuttings removal devices. These drill cuttings removal devices include vibratory screen shakers, also know as shale shakers, that are well known in the art. The secondary shaker 11 utilized as described above may also be selected from anyone of a number of well know drill cuttings removal devices. It is contemplated that a Vibro-Energy round separator, such as that manufactured by Sweco, P.O. Box 1509, 8029 US Highway 25, Florence, Ky. 41022 USA, would provide the secondary liquids separation described for the shaker 11 though a vibratory screen shaker or other solids separator could also be utilized.

The compactor 18 of Applicant's invention is utilized to crush and compress the drill cuttings received from shakers 10 and 11 into a plurality of discrete compacted massed bodies drill cuttings of a substantially uniform size such as a pellet, a hard cake or briquette. If necessary, bonding agents such as lignite may be added to the compactor 18 along with the collected drill cuttings to facilitate compressing the collected drill cuttings into a plurality of discrete compacted massed bodies drill cuttings.

When the drill cuttings are compressed into a plurality of discrete compacted massed bodies of drill cuttings by the compactor 18, liquids and drilling mud fluids that may have been retained by or with the drilling cuttings after their exposure to shakers 10 and 11 may be further separated from the cuttings by the compactor 18. Any fluids so separated by the compactor 18 are collected and returned to the mud storage tank 16 via return line 22. After compression, the discrete compacted massed bodies of drill cuttings are delivered by conveying means 20 to empty storage bags 24 and the empty storage bags 24 are then filled with the compacted massed bodies of drill cuttings. As each storage bag 24 is filled with the compacted massed bodies of drill cuttings, another bag 24 is put in its place. After being filled with compacted massed bodies of drill cuttings, each filled storage bag 28 is stored on the rig site at a desired location until the filled storage bags 28 are ultimately delivered to a desired end location 30.

The intent of the compactor 18 is to crush and compress the drill cuttings into compacted massed bodies of drill cuttings of a substantially uniform size and shape. Any number of commercially available compactors, including auger extruders, ram extruders and briquetting machines, may be utilized as the compactor 18. Extruders typically have a hopper for delivering material, in this case the drill cuttings, to a trough. A ram or an auger located within the trough then pushes the drill cuttings in the trough through a die having a plurality of openings of a desired size. When the cuttings are pushed through the openings of the die they are thereby crushed and compressed into a discrete massed body of a desired shape.

Extruders produce pressure on cuttings in the range of 100 psi to 3000 psi depending upon, as one factor, the size of the openings in the die being used. Dies may have openings of varying sizes and openings in dies may range from about 1/32 of an inch to about 8 inches or more in diameter. Testing has shown that cuttings extruded under pressures in the range of 300 psi to 500 psi, through dies having openings in the range of about ¼ inches to about ¾ inches, produce compressed cuttings pellets of about ¼ inches to about ¾ inches in diameter and that these pellets have a satisfactory compression, size and water content for being transported in the storage bags 24. It is thought that a single extruder could process 8 to 10 tons of cuttings per hour. One example of an extruder that may be utilized as the compactor 18 is the Terrrier Extruder manufactured by The Bonnot Company, 1520 Corporate Woods Parkway, Uniontown, Ohio 44685, USA Examples of briquetting machines that may be utilized as the compactor 18 are those manufactured by K. R. Komarek Inc., 1825 Estes Avenue, Elk Grove Village, Ill. 60007, USA Such briquetting machines have a hopper for delivering a quantity of material, in this case drill cuttings, between pairs of opposing rollers. These rollers have plurality of uniformly spaced, selectively sized, indentations. When the drill cuttings are moved between the opposing rollers they are squeezed into the recesses of the rollers and there by compacting the drill cuttings into briquettes of a desired size and shape. While briquetting machines will produce briquettes in a variety of different sizes, it is thought that briquetting machines that produce briquettes of about ¾ of an inch to about 1-½ inches in width, of about 1 inch to about 2-½ inches in length an of about ½ of an inch to about 1 inch in thickness would provide briquettes of massed drill cuttings having a satisfactory compression, size and water content for being transported in the storage bags 24.

Compressing the cuttings into discrete pellets or briquettes of substantially uniform dimensions by means of compactor 18 serves to substantially reduce the volume of the drill cuttings. Such compression also serves to further remove liquids and drill fluids from the cuttings. Volume reduction and liquid removal facilitates handling, storage and disposal of the drill cuttings.

After the drill cuttings have been compacted into pellets or briquettes by the compactor 18, the compacted cuttings are transported via conveyor 20 to a bagging area where the compacted cuttings are placed into a plurality of sealable bags 24 for storage. Each bag 24 is hung from or is otherwise supported by a bag storage rack 26 when being filled with the compacted cuttings. Straps or loops on the bag 24 maybe used to facilitate supporting the bag 24 on the bag storage rack 26. The conveyor 20, bag 24 and bag rack 26 may be positioned so as to allow gravity delivery of the compacted cuttings to the bag 24 for filling. An endless belt or an endless screen conveyor, rather than an auger conveyor, is used as the conveyor 20 to minimize the potential for breaking up the pellets.

When each bag 24 is filled, it is sealed, removed from the rack 26, and replaced with another storage bag 24. A small crane or mechanical lift is utilized to move each filled storage bag 28. Each filled storage bag 28 is collected on the rig site and stored at a desired area prior to being transported to a desired location 30 away from the rig site. Removal of the filled bags 28 to location 30 may be by boat, in the case of offshore drilling sites, or by truck or rail, in the case of onshore drilling sites. The location 30 may be any desired location including a landfill, a processing center for further processing of the cuttings, or another interim storage facility.

The bags 24 used for storing the compacted cuttings may be any collapsible, re-sealable storage bag. It is thought that a collapsible, reusable, heavy weight, fluid impervious bag having a sealing and re-sealing means such a storage bag 24 made of PVC would be sufficient. Other bags such waterproofed bags made of canvas, nylon, vinyl, or other such fabrics could also be utilized for the bags 24. Because each bag 24 is collapsible, it is intended that it may be folded for storage and transporting to the well location. Folded bags are light and non-bulky and take up substantially less space and are of substantially less weight than the rigid storage boxes presently utilized for drill cuttings storage and transportation. The reduced size and weight of the storage bags decrease the costs associated with cuttings disposal.

While the system shown is specifically intended for use in handling drill cuttings produced during the drilling of oil and gas wells, it will be apparent from this disclosure that the system shown and described might be readily modified for use in other applications. One such application is for use in the handling, compacting and storage of solids removed from a liquid waste collection area during cleanup. Examples of such waste collection areas include oilfield waste storage pits and tanks and the hulls of barges or ships.

In such use, the compactor 18; the shakers 10 and 11, if necessary; return lines 14, 17, 22; the associated conveyors 12, 13, 15, 20; the bags 24 and bag racks 26 may be transported and assembled in the described manner at a desired location such as a storage tank site. At such storage tank site, the system could be assembled to compress and de-water solids that are removed during the tank cleaning process. Since a storage tank site does not necessarily have drilling system, a well bore and a mud circulating system as described above, a solids delivery line for delivering tank liquids and liquid borne solids to the shaker 10 would replace the mud line 8 depicted in FIG. 1 and the liquid return lines 14, 17 and 22 would be directed to return to the tank being cleaned rather than to a mud storage tank 16. Otherwise the system utilized for compacting and de-watering the solids removed from a tank during cleanup is essentially that depicted in FIG. 1 for handling drill cuttings.

The solids removed from the tank during cleaning are collected and delivered to compactor 18, compressed to pellets or briquettes of desired dimensions and conveyed to storage bags 24 in the manner described above. If necessary, bonding agents such as lignite may be added to the solids to facilitate compressing the collected solids into pellets or briquettes. The filled storage bags 28 are then collected and transported to a desired location 30. Such a location 30 may be a landfill or an interim site for further processing.

Pelletized solids are particularly suitable for landfill disposal because the volume of the solids and the solids water content is substantially reduced due to the compacting process used to produce the pelletized solids. The method described by Applicants herein, with or without the use of the storage bags 24 and with or without the use of separators, could be applied at a landfill location to process incoming solids prior to disposal. Processing incoming solids in the manner described would reduce the volume to the solids and thereby save valuable landfill space and ultimately reduce the cost of landfill disposal.

It is thought that the drill cuttings handling system and method depicted herein and its attendant advantages will be understood from the foregoing description and changes may be made in the form, construction and arrangement of the parts thereof without departing from the spirit and scope of the invention or sacrificing all of its material advantages.

We claim:

1. A method of removing drill cuttings from the drilling mud of a drilling mud system of an oil and gas well drilling rig, comprising the steps of:

a) providing a plurality of collapsible storage bags;

b) separating drill cuttings from the drilling mud;

c) then, transporting the drill cuttings so separated to a compactor;

d) then, compacting the drill cuttings so separated into a plurality of discrete compacted bodies of a substantially uniform size;

e) then, filling each of said storage bags with said discrete compacted bodies of drill cuttings; and f) then, delivering said filled storage bags to a desired end location.

2. The method as recited in claim 1, wherein said drilling mud is delivered to a drilling mud storage tank after said step of separating said drill cuttings from the drilling mud is completed.

3. The method as recited in claim 2, wherein each of said storage bags is supported on a bag rack when each of said storage bags is filled with said discrete compacted bodies of drill cuttings.

4. The method as recited in claim 3, wherein said storage bags are made of PVC.

5. The method as recited in claim 3, wherein said step of filling said storage bags comprises the additional the steps of:

a) providing a conveyor for receiving said discrete compacted bodies of drill cuttings from said compactor;

b) conveying said discrete compacted bodies of said drill cuttings to said storage bags; and c) allowing said discrete compacted bodies to fall off said conveyor into each of said storage bags and thereby filling each of said storage bags.

6. The method as recited in claim 5, further comprising the step of adding a bonding agent to said compactor along with the drill cuttings so separated to said compactor so as to facilitate compacting the drill cuttings so separated into a plurality of discrete compacted bodies of a substantially uniform size.

7. The method as recited in claim 2, wherein any fluids produced from said step of compacting the so separated drill cuttings is conveyed to said mud storage tank.

8. The method as recited in claim 7, wherein said compactor in said step of transporting said the drill cuttings so separated to a compactor includes an extruder.

9. The method as recited in claim 8, wherein said extruder crushes and compresses said drill cuttings at a range of pressures between 300 psi to 500 psi.

10. The method as recited in claim 9, wherein said extruder extrudes compacted bodies of said drill cuttings having a diameter in the range of about ⅜ of an inch to about ¾ of inch.

11. The method as recited in claim 10 wherein said extruder is an auger extruder.

12. The method as recited in claim 10, wherein said extruder is a ram extruder.

13. The method as recited in claim 7, wherein said compactor in said step of transporting said the drill cuttings so separated to a compactor includes a briquetting machine.

14. A method for handling solids retained in a liquid slurry comprising:

(a) providing a means for separating solids from the liquid slurry;

(b) providing a compactor means for crushing and compacting said solids so separated from said liquid slurry into discrete massed bodies;

(c) transporting said solids so separated from said liquid slurry to said a compactor means;

(d) crushing and compacting said solids into discrete massed bodies of said separated solids;

(e) providing at least one storage bag for storing said discrete massed bodies of said separated solids;

(f) conveying said discrete massed bodies of said separated solids from said compactor means to said storage bag;

(g) filling said storage bag with said discrete massed bodies of said separated solids; and (h) transporting said filled storage bag to a desired end location.

15. The method as recited in claim 14, further comprising the step of adding a bonding agent to said compactor along with said solids so separated from said liquid slurry to said compactor means so as to facilitate crushing and compacting said solids into discrete massed bodies of said separated solids.

16. A method of disposing drill cuttings produced from the drilling mud of a drilling mud system of an oil and gas well drilling rig, comprising the steps of:

a) providing a plurality of collapsible storage bags;

b) separating drill cuttings from the drilling mud;

c) supporting each of said storage bags on a bag rack;

d) compacting said drill cuttings so separated into a plurality of discrete compacted bodies of a substantially uniform size;

e) filling each of said storage bags with said drill cuttings so separated; and f) then, delivering each of said storage bags so filled to a desired end location.

17. The method as recited in claim 16, wherein the step of compacting said drill cuttings so separated includes extruding said drill cuttings so separated with an extruder.

18. The method as recited in claim 17 wherein said extruder is an auger extruder.

19. The method as recited in claim 17, wherein said extruder is a ram extruder.

20. A method as recited in claim 16 wherein the step of compacting said drill cuttings so separated includes compressing said drill cuttings so separated into briquettes by means of a briquetting machine.

21. The method as recited in claim 16 wherein each of said plurality of storage bags is reusable.

22. A method of disposing drill cuttings produced from the drilling mud of a drilling mud system of an offshore oil and gas well drilling platform, comprising the steps of:

a) providing a drilling rig on an offshore drilling platform for advancing a subsurface borehole, said drilling rig having a system for circulating drilling mud through said borehole and thereby returning drill cuttings from said borehole to the surface of said borehole as said borehole is advanced, said drilling mud system being comprised of a mud supply tank, a drill string, borehole casing pipe; mud pumps; means for separating said drill cuttings from said circulating drilling mud; and means for returning said circulating drilling mud to said mud tank absent said drill cuttings;

b) providing a plurality of collapsible storage bags, said bags having a top opening;

c) providing a rack for holding at least one of said storage bags with said top opening in an open position;

d) selecting a storage bag from said plurality of storage bags and positioning said selected storage bag on said rack with said top opening of said bag in a open position;

e) separating said drill cuttings from said circulating drilling mud;

f) providing means for delivering a quantity of said separated drill cuttings from said cuttings separating means to said selected collapsible storage bag;

g) filling each of said selected storage bag with said quantity of said separated drill cuttings;

h) storing each said storage bag with said quantity of said separated drill cuttings bags in a desired temporary location on said drilling platform; and i) transporting each said storage bag with said quantity of said separated drill cuttings bags from said drilling platform to a desired disposal location.

23. The method as recited in claim 22, providing the additional step of delivering said drilling mud, absent said drill cuttings, to said mud supply tank after said step of separating said drill cuttings from the drilling mud is completed.

24. The method as recited in claim 23, wherein said step of transporting each said storage bag with said quantity of said separated drill cuttings from said drilling platform to a desired disposal location includes:

(a) delivering each said storage bag with said quantity of said separated drill cuttings to a landfill;

(b) removing said quantity of said separated drill cuttings from each said storage bag; and (c) disposing each said quantity of said separated drill cuttings at said landfill.

25. The method as recited in claim 22 wherein each of said plurality of storage bags is reusable.

26. The method as recited in claim 25 providing the additional step of compacting the drill cuttings so separated into a plurality of discrete compacted bodies after said step of separating said drill cuttings from said circulating drilling mud is completed.

* * * * *